US009811977B2

(12) United States Patent
Gonzalez-Roa et al.

(10) Patent No.: US 9,811,977 B2
(45) Date of Patent: Nov. 7, 2017

(54) BINGO-TYPE WAGERING GAME DURING PLAY OF KENO OR AS A DISTINCT GAME

(71) Applicants: Andres Gonzalez-Roa, Las Vegas, NV (US); Mark L. Yoseloff, Henderson, NV (US)

(72) Inventors: Andres Gonzalez-Roa, Las Vegas, NV (US); Mark L. Yoseloff, Henderson, NV (US)

( * ) Notice: Subject to any disclaimer, the term of this patent is extended or adjusted under 35 U.S.C. 154(b) by 91 days.

(21) Appl. No.: 15/002,523

(22) Filed: Jan. 21, 2016

(65) Prior Publication Data

US 2016/0240039 A1 Aug. 18, 2016

Related U.S. Application Data

(60) Provisional application No. 62/106,134, filed on Jan. 21, 2015.

(51) Int. Cl.
*G07F 17/32* (2006.01)

(52) U.S. Cl.
CPC ..... *G07F 17/329* (2013.01); *G07F 17/3225* (2013.01)

(58) Field of Classification Search
USPC ..... 463/18, 19, 22
See application file for complete search history.

(56) References Cited

U.S. PATENT DOCUMENTS

| | | | | |
|---|---|---|---|---|
| 8,430,737 | B2 * | 4/2013 | Saunders | G07F 17/3211 463/16 |
| 2008/0214292 | A1 * | 9/2008 | Bryant | G07F 17/32 463/25 |
| 2011/0118005 | A1 * | 5/2011 | Bryant | G07F 17/32 463/20 |
| 2013/0023336 | A1 * | 1/2013 | Saunders | G07F 17/326 463/25 |
| 2013/0090154 | A1 * | 4/2013 | Bryant | G07F 17/32 463/20 |
| 2013/0303259 | A1 * | 11/2013 | Saunders | G07F 17/34 463/20 |

* cited by examiner

*Primary Examiner* — Pierre E Elisca
(74) *Attorney, Agent, or Firm* — Mark A. Litman & Associates, P.A

(57) ABSTRACT

A method and system for operating a wagering event includes one to four outcomes on random number correspondence to numbers in a four by four array of predefined numbers. To win any wager, an active random number must appear in a preselected corner frame. The method may be an independent game or may be a side bet/wager in a keno game. Separate wagers may be placed on the one to four outcomes, with progressive correspondence of random numbers to the four by four array of predefined numbers, winning outcomes on any wager are dependent upon sequences of correspondence of the predefined numbers, especially in a vertical, horizontal or diagonal order. Use of an electronic gaming machine with a touchscreen facilitates the method and simplifies the system. It is preferred that the numbers in the array are printed onto a paper or other material sheet.

26 Claims, 4 Drawing Sheets

FIGURE 2

| | | | |
|---|---|---|---|
| A-1 | B-1 | C-1 | D-1 |
| A-2 | B-2 | C-2 | D-2 |
| A-3 | B-3 | C-3 | D-3 |
| A-4 | B-4 | C-4 | D-4 |

BINGO-TYPE WAGERING GAME DURING PLAY OF KENO OR AS A DISTINCT GAME

RELATED APPLICATIONS DATA

This application claims priority from U.S. Provisional Patent Application Ser. No. 62/106,134, filed 21 Jan. 2015 and titled "BINGO-TYPE WAGERING GAME DURING PLAY OF KENO OR AS A DISTINCT GAME."

BACKGROUND OF THE INVENTION

1. Field of the Invention

This invention is related to the field of gaming technology and random selection of numbers identifying frames and winning outcomes in comparison with correspondence of frames and randomly selected symbols.

2. Background of the Art

Keno is similar to Lotto. It was first introduced in China many years ago. The game was brought to the United States in the mid 1800's by Chinese immigrants who came to work in the mines and on the railroad. It is a very popular game and very easy to play. It is an exciting pastime and, most importantly, it offers the possibility of winning large payouts on relatively small wagers.

Keno is usually played in Casino lounges specifically allocated for the game, but there are so called 'Keno runners' who will collect tickets and deliver the winnings if the player wants to play from outside the lounge area. There are many television monitors spread all over the Casino halls to keep players informed of the winning numbers. There is also the video version of Keno. These are video slot-like coin, credit or ticket-in operated machines. It plays using the same principle with similar rules of the regular Keno, but the results occur much faster.

To play Keno, a player selects a minimum of 4 but no more than 10 numbers between 1 and 80. Each selection is called a 'Spot', so if 10 numbers are selected, a 10 Spot game is being played. Keno tickets are located at tables throughout the Casino and in the Casino's Keno lounge. The Casino provides a 'Keno crayon' for this purpose. A player simply marks a blank Keno ticket (or virtual electronic ticket on a gaming device) with the numbers of the selection. The ticket is presented to the Keno desk (or received by a processor that executes code to effect game play) with the wager and the clerk provides a duplicate ticket (or the processor indicates the selections on the video display). In a few minutes (or in less than a minute on electronic play), twenty numbered Keno balls will be drawn at random from a barrel containing 80 numbered balls (or 20 virtual balls or 20 random numbers are provided by a random number generator associated with and in communication with the processor), and if enough of the selected numbers are drawn, a winning event outcome occurs. The results are displayed on screens (or the video screen), called Keno boards, throughout the Casino.

Minimum bets can be as low as 5 cents, although some Casinos only accept bets of $1 or more. The house's Keno brochure gives information about payoffs and various tickets that can be played. The amount of money won is dependent upon the type of ticket played and the number of 'spots' caught. A player may wager on as many tickets as desired. One could win as much as $50,000 on a $1 wager in some Casinos.

The round of a Keno game is called a Keno race. In many Casinos, 'multi-race' Keno is featured, where one can play a number of consecutive Keno races at one time. The house advantage on Keno varies according to the Keno game played. It is always around 30% or more. The chance of hitting one number in 80 is 0.25.

Many variants and side bet or bonus games have been developed for play with Keno. Published U.S. Patent Application Document No. 20080070670 (Brunelle) describes a keno game including a set of playable symbols, from which a set of player symbols are selected. A set of winning symbols are selected from a set of potential winning symbols, with the set of potential winning symbols including the set of playable symbols and at least one wild symbol. The wild symbol may match any one of the player symbols, none of the player symbols, or a range of player symbols. The playable symbols are preferably numbers. Payouts preferably follow a pay table having a weighted probability based on the total number of symbols in the set of potential winning symbols.

Published U.S. Patent Application Document No. 20070173312 (Dodge) describes a novel Keno game wherein a player selects up to ten numbers from a field of eighty numbers to be played and these numbers are compared to twenty numbers randomly selected by the game from the same field of numbers in a manner known in the prior art. When the player places one or more conventional bets on the outcome of the game, they now also place one or more side bets as to the number of hits or matches there will be between the player selected numbers and twenty numbers selected by the game computer. The player may place side bets on more than one number of hits or matches to increase their odds of achieving side bet winnings Published U.S. Patent Application Document No. 20090197664 (Schultz) discloses a keno game having a bonus round. The keno game provides a player with an additional opportunity to win, after the keno balls have been drawn, to add excitement and volatility to the standard keno game. According to one method, the gaming machine receives the player's input, with the player selecting one or more numbers. A keno draw, which includes a plurality of numbers from a keno pool, is then displayed to the player. A bonus round is initiated in response to a trigger event. The bonus round is a random selection of one or more numbers in addition to the numbers previously selected from the keno draw. The numbers selected from the bonus round are displayed to the player. The numbers selected by the player are evaluated again the numbers from the keno draw results as well as the bonus round, and a payout for any winning outcomes are awarded to the player.

Published U.S. Patent Application Document No. 20060178196 (Thomas) describes a method of playing a keno-type wagering game. The method includes conducting the keno-type wagering game at a gaming terminal. The keno-type wagering game has a plurality of game cards and a plurality of symbols. At least some of the plurality of symbols to be used by a player in the wagering game is displayed to the player. A first set of symbols from the plurality of symbols is selected, and applies to all of the plurality of game cards. The method further includes randomly generating a plurality of second sets of symbols from the plurality of symbols. Each of the plurality of second sets includes a first symbol and each of the first symbols of each of the plurality of second sets is displayed simultaneously. In response to at least one of the symbols of the plurality of second sets matching a symbol from the first set, the player receives an award.

U.S. Pat. No. 8,651,936 (Smith) discloses a wagering game is played on an electronic system with a processor, a video display screen and a player input system. The processor recognizing a wager, enabling player input at the specific player position. The processor executes code to display a grid of at least 50, preferably at least 80 frames for display of a unique symbol within each frame of the grid. The processor compares recognized at least three symbols at the specific player position with at least 10 symbols selected by the processor. The processor displays a first arrangement of unique symbols within each frame prior to recognizing selection at the specific player position, and B) the processor displays a second arrangement of the same unique symbols after recognizing selection at the specific player position, the first arrangement of symbols being different from the second arrangement of symbols with respect to distribution of symbols among the frames.

In the gaming industry, the underlying basis of all games is the provision of random events having determinable measures of outcomes. Wagers are placed against specific outcomes, and those wagers are resolved based upon the final or intermediate outcome of events. Many different gaming elements are used to provide the random outcome of events, including but not limited to playing cards, dice, roulette wheels, candy wheels, random ball selection, and since the introduction of processors to the gaming industry, random event generation through random number generator. The use of random number generators and processors has enabled the generation of random symbols and numbers corresponding to the physical objects traditionally used in wagering games such as the dice, playing cards, roulette wheels and random ball selection (as in bingo and keno). The addition of processors enables more rapid play, and more ability to design variations in game play than with purely physical systems. Many different and new forms of wagers can also be provided and more quickly resolved by the processor than by croupier or dealer manual resolution.

Basically, players buy cards with numbers on them in a 5.times.5 grid corresponding to the five letters in the word B-I-N-G-O. Numbers such as B-2 or 0-68 are then drawn at random (out of a possible 75 in American Bingo, and 90 in British and Australian Bingo) until one player completes a 'Bingo' pattern, such as a line with five numbers in a vertical, horizontal or diagonal row on one of their cards and wins the prize. There are many possible patterns to play for. There are some variants of Bingo that use 3.times.3 playing cards.

A bingo Card contains 24 numbered spaces and one free space (blank), with which you play BINGO. The numbers are assigned at random on each card and are arranged in five columns of five numbers each by five rows (5.times.5=25 in total including the blank square).

The numbers in the B column are between 1 and 15, in the I column between 16 and 30, in the N column (containing four numbers and the free space) between 31 and 45, in the G column between 46 and 60, and in the O column between 61 and 75.

Players have thousands of unique (unduplicated) cards to choose from. Some manufacturers print unduplicated series of 6,000 cards. There are also series of 9,000 cards available. Hard cards and Flimsy cards have a series number printed on them. For example, card number 1252 will always have the same numbers in the same spaces.

Among the variants of Bingo that have been suggested in the art are the following. U.S. Patent Application Publication No. 20060160603 (Lulek) discloses a video gaming system that combines multi-card bingo play with familiar and desirable entertainment elements such as spinning reels with fruit or other symbols. The game programming produces multiple bingo card representations on monitors at a plurality of game terminals. Drawn numbers ("balls") are displayed one after another. An eight card bingo game pays a prize for a bingo win achieved on a card when less than a predetermined number of balls have been drawn and also when a cover-all or other predetermined game-ending pattern is achieved on a card that has not previously provided a prize affording win. A nine card eight line game displays bingo cards in a three-by-three grid. Prizes are awarded for pre-selected bingo wins accomplished in one of eight three-in-a-row patterns of cards running horizontally, vertically or diagonally. In the nine card, eight line game each winning card is associated with a symbol representative of the bingo win. The symbol is presented by a representation of a spinning reel coming to rest at that symbol.

U.S. Patent Application Publication No. 20040121834 (Libby) discloses a lottery bingo system graphically portraying an animated bingo game. The lottery system includes a bingo game generator which comprises an animation drawing subsystem. The animation drawing subsystem retrieves bingo call video segments corresponding to a sequence of drawn bingo numbers randomly drawn for a bingo game after dispensing of bingo tickets for the bingo game is ended, and compiles the bingo call video segments into a bingo game video.

U.S. Pat. No. 8,070,161 (Ward) describes wagering systems using a game ball has two different game indicia associated therewith. One or more of such game balls may be part of a set of game balls, such as a set of balls used to play a bingo, keno or lottery game where the game indicia may comprise numbers used to play lottery or keno, or combinations of letters and numbers for play of a bingo game. Compared to game balls bearing a single game indicia, selection of a game ball bearing multiple game indicia presents a player with an increased or bonus matching opportunity. The game balls may be physical elements or be electronic representations, such as displayed images, thereof.

U.S. Pat. No. 8,002,623 (Resnick) provides methods and devices for presenting a plurality of game elements on one or more display devices. The game elements may comprise, for example, bingo cards, playing cards, hands of playing cards, etc. Some implementations of the invention involve displaying a plurality of game elements as surfaces of a three-dimensional object. Preferably, the orientation of the three-dimensional object can be varied to display selected game elements. The game elements may be selected by a player and/or by a logic device. In some implementations, the three-dimensional object comprises a "carousel" that can be re-oriented (e.g., rotated) to display game elements.

U.S. Pat. Nos. 7,794,319 and 7,481,707 (Luciano) disclose a system and method for generating bingo game bonuses that are non-banked, for use with pooled bingo games. The system generates pools of money for use in bingo games by deducting a percentage of the amount used to purchase bingo cards (in the present invention, virtual bingo cards). Each bingo game automatically enrolls active players in one or more bonus games, exemplified by "4 corners," where the amounts to be given away to players as bonuses are calculated to be equal, over time, to the amount taken in from players buying bingo cards. The house has no stake in the bonus awards.

U.S. Pat. No. 6,565,091 (Weingardt) describes a bingo game in which bingo numbers are assigned to at least five different groups. The groups are preferably identified by color, and the size of the groups preferably vary, with the result that a bingo consisting of a combination of numbers from the smallest group will be harder to achieve than a bingo consisting of a combination of numbers from a larger group. The jackpot sizes will vary in relation to the difficulty of achieving a particular bingo. The group sizes are within certain preferred ranges, designed to minimize the risk of premature bingos and thus to increase jackpot size and player excitement. Preferably, image type indicia are also added to certain of the numbers, creating additional bingo combinations and jackpot opportunities.

U.S. Pat. No. 7,695,361 (Lind) describes determination of a pattern probability by for each of a number of target patterns achievable in a bingo-type game. Each pattern probability comprises a probability of achieving the respective target pattern in the bingo-type game. Different pattern sets are then associated with each different prize level in a desired prize distribution. The target patterns and their respective pattern probabilities are assigned or mapped to the different pattern sets so that the probability of achieving any target pattern included in a pattern set comprises a value approximating the desired probability of the prize level with which the pattern set is associated.

U.S. Pat. No. 5,935,002 (Faciglia) describes a device for playing a bingo-style game including an input device for receiving user inputs; a display for displaying a graphic user interface (GUI); and a processor. The GUI includes a five column by five row random number display matrix; five display regions; and a plurality of user-actuatable icons. The processor includes a first random number generator for generating five sets of random numbers for display by the five column by five row random number display matrix, in which the five sets of random numbers are grouped in predetermined ranges. The processor also includes a second random number generator which responds to the user inputs corresponding to actuation of the actuation icon by the user for generating a sixth set of random numbers for display by the five display regions. The processor compares the sixth set of random numbers displayed in the five display regions with the numbers in the columns of the display matrix, and allows the processor to automatically cover the matching number in the display matrix. The processor determines whether the display matrix has five numbers covered in a row, in a column, or in a diagonal, and generates a bingo indication signal for indicating a bingo condition.

U.S. Pat. No. 8,777,718 (Smith) discloses a method of playing a wagering game on an electronic gaming system provides: i) an image of a virtual playing card having frames within m columns and n rows wherein each of m and n are at least 3; ii) providing a random distribution of individual numbers within the frames, the individual numbers selected from within a complete defined set of numbers; iii) recognizing a wager; iv) selecting a second set of numbers smaller than the complete defined set; v) identifying on the monitor selected numbers matching individual random numbers within the frames; vi) identifying when consecutive frames have at least p matched individual random numbers within frames in a column, row or diagonal; vii) resolving the at least wager such that a) when matched individual random numbers do or do not form at least p adjacent frames. All documents cited are incorporated herein by reference in their entirety.

SUMMARY OF THE INVENTION

A method and system for operating a wagering event includes one to four outcomes on random number correspondence to numbers in a four by four array of predefined numbers. To win any wager, an active random number must appear in a preselected corner frame. The method may be an independent game or may be a side bet/wager in a keno game. Separate wagers may be placed on the one to four outcomes, with progressive correspondence of random numbers to the four by four array of predefined numbers, winning outcomes on any wager are dependent upon sequences of correspondence of the predefined numbers, especially in a vertical, horizontal or diagonal order. Use of an electronic gaming machine with a touchscreen facilitates the method and simplifies the system.

BRIEF DESCRIPTION OF THE FIGURES

FIG. 2 shows distribution and nomenclature of a set of 4 frames by 4 frames according to the present technology.

DETAILED DESCRIPTION OF THE INVENTION

Figure 1:
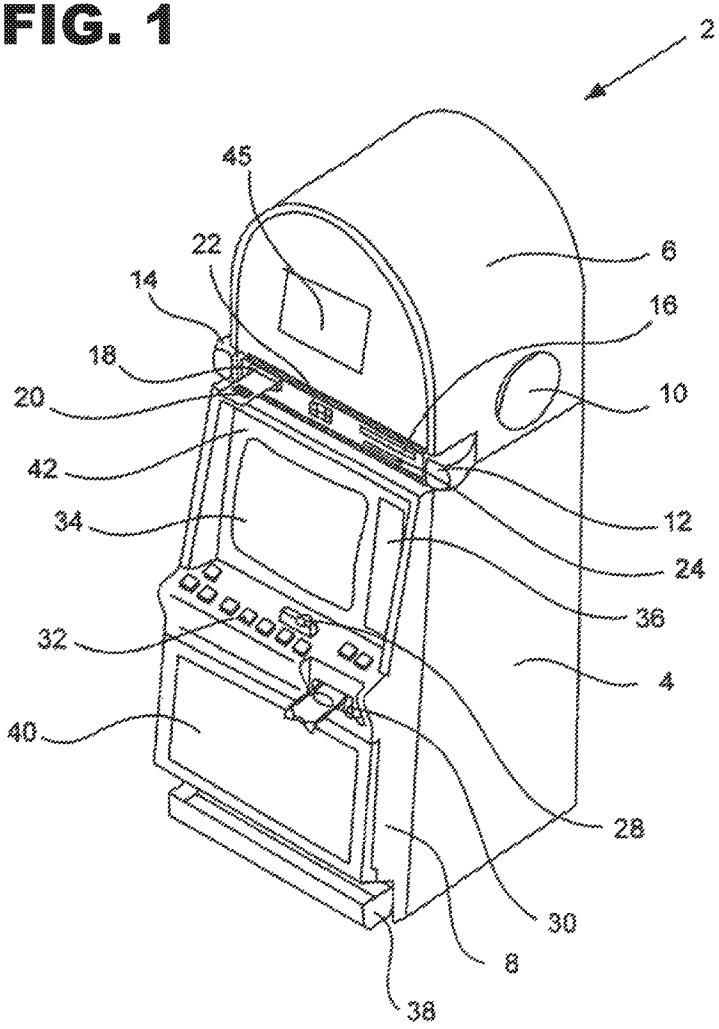
FIG. 1 shows an electronic gaming table on which the gaming method may be executed.

A method of operating a wagering event may include steps of:

a) receiving at least a first wager from a player position and optionally a second wager, the second wager and a third wager, or the second wager, the third wager and a fourth wager.

The first wager is on a single corner frame on a four by four frame array, as detailed in greater extent herein. Second, third and fourth wagers are 'extensions' of the first wager, requiring a win on the first wager to remain active and having a potential for a winning outcome.

b) providing a set of at least 50, at least 60 or at least 70 numbers (preferably up to 80 or up to 100 numbers).

The at least 50, 60 or at least 70 numbers are preferably the set of numbers used in a keno game or bingo game, such as 75 through 80 numbers. These numbers may be displayed on a game board, including, for example, a display screen on an electronic gaming machine or kiosk. As in a keno parlor, or networked keno screen, the at least 70 numbers (applicant will refer to at least 70 numbers as a general framework, while not restricting the numbers allowed elsewhere in thi disclosure) are displayed on a visible screen and the at least 20 random numbers selected may be displayed on the visible screen by electronic input as known in the art. Either electronic entry on a player input device (electronic gaming machine, smart phone, electronic pad, electronic tablet, etc.) or paper game tickets may be printed and provided. The "paper" may be any sheet material that is receptive to imaging such as printing by any of the numerous formats. For security, the printing may be on security paper with watermarks, hidden security content, invisible security markings, bar codes, QR codes and the like.

c) providing exactly a 4 frame×4 frame betting array at the player position, the array having a major corner frame.

In execution of the present wagering events, the major corner frame may be predefined in all wagering events (such as in the lower right hand corner or other corner) or may be selected by individual players and entered as part of player selection activity. The processor may also randomly select a corner and the major corner frame.

a) providing 16 numbers from within the set of 70 numbers, one of the 16 numbers being in each frame of the 4 frame by 4 frame array.

The selection may be a random selection (e.g., such as a Quick-Pick selection) by the processor/computer or may be selected by player input and randomly placed in the array, or selected by player input and then at least one number (and possible all numbers) placed by player input selection. Various means of placement such as touchscreens, buttons, joy stick, mouse, audio response, buttons or combinations thereof may be used to select and place the predefined numbers into the four by four frame array.

b) randomly selecting at least 20 numbers from the set of at least 70 numbers.

The random selection may be physically performed (e.g., by ball drop, random ball selection, random number generation and the like. This function is fairly commonly performed in the play of keno and related games, so that this aspect of the technology may be easily transferred across gaming technologies into execution of the present technology.

c) identifying correspondence between the at least 20 numbers and individual ones of the 16 numbers in the 4 frame by 4 frame array.

This can be done by reading of physical tickets by a scanner (e.g., bar code, QR code, ticket numbers, image scanning, etc.), or keno-type or bingo-type electronic comparison by a computer/processor in the electronic gaming machine or player terminal.

d) the first wager being resolved on at least one basis consisting of:

1) a number in the major corner frame corresponds to one of the at least 20 numbers selected is a winning outcome on the first wager and the first wager is resolved at first odds, and failure of a number in the major corner frame to correspond to one of the at least 20 numbers selected ends the first wager which is withdrawn from the player position;

2) only upon occurrence of the winning outcome in step 1), correspondence of any first tier of adjacent frames to the major corner frame to any of the at least twenty numbers requires positive resolution on the second wager with second odds higher than the first odds in the resolution of the first wager;

3) only upon occurrence of the winning outcome in step 2), correspondence of any further second tier adjacent frames to the first tier of adjacent frames having numbers therein corresponding to the at least 20 numbers and which are adjacent to the major corner frame to any of the at least twenty numbers requires positive resolution of the third wager at third odds, with the third odds higher than the second odds in the resolution of the second wager; and 4) only upon occurrence of the winning outcome in step 3), correspondence of any further third tier adjacent frames to the second tier of adjacent frames having numbers therein corresponding to the at least 20 numbers and which are adjacent to the second tier of frames requires positive resolution of the fourth wager at fourth odds, with the fourth odds higher than the third odds in the resolution of the third wager.

An alternative description of the present invention is as a method of operating a wagering event including steps of:

a) receiving at least a first wager from a player;

b) providing a set of at least 50 numbers;

c) providing exactly a 4 frame×4 frame betting array on printed papers, the array having a major corner frame;

d) providing 16 numbers from within the set of 50 numbers, one of the 16 numbers being printed in each frame of the 4 frame by 4 frame array, with at least one printed number from the 16 numbers being in a corner of the 4 frame by 4 frame array, and that corner is thereafter designated as the major corner;

e) randomly selecting and displaying at least 20 numbers from the set of at least 50 numbers;

f) marking the printed papers to at least highlight each one of the randomly selected at least 20 numbers that is also printed in a frame on the printed papers, and identifying correspondence between the randomly selected at least 20 numbers and individual ones of the 16 numbers in the 4 frame by 4 frame array;

g) the at least first wager being resolved on at least one basis consisting of:

1) a number in the major corner frame corresponds to one of the randomly selected at least 20 numbers selected is a winning outcome on the first wager and the first wager is resolved at first odds, and failure of a number in the major corner frame to correspond to one of the at least 20 numbers selected ends the first wager which is withdrawn from the player position;

2) only upon occurrence of the winning outcome in step 1), correspondence of any first tier of adjacent frames to the major corner frame to any of the randomly selected at least twenty numbers requires positive resolution on a second wager with second odds higher than the first odds in the resolution of the first wager;

3) only upon occurrence of the winning outcome in step 2), correspondence of any further second tier adjacent frames to the first tier of adjacent frames having numbers therein corresponding to the randomly selected at least 20 numbers and which are adjacent to the major corner frame to any of the at least twenty numbers requires positive resolution of a third wager at third odds, with the third odds higher than the second odds in the resolution of the second wager; and 4) only upon occurrence of the winning outcome in step 3), correspondence of any further third tier adjacent frames to the second tier of adjacent frames having numbers therein corresponding to the randomly selected at least 20 numbers and which are adjacent to the second tier of frames requires positive resolution of a fourth wager at fourth odds, with the fourth odds higher than the third odds in the resolution of the third wager.

Another alternative description of the present technology is as a method of operating a wagering event including steps of:

a) receiving at least a first wager from a player;

b) providing a set of at least 50 numbers;

c) providing exactly a 4 frame×4 frame betting array on printed papers, the array having a major corner frame;

d) providing 16 numbers from within the set of 50 numbers, one of the 16 numbers being printed in each frame of the 4 frame by 4 frame array, with at least one printed number from the 16 numbers being in a corner of the 4 frame by 4 frame array, and that corner is thereafter designated as the major corner;

e) randomly selecting and displaying at least 20 numbers from the set of at least 50 numbers;

f) marking the printed papers to at least highlight each one of the randomly selected at least 20 numbers that is also printed in a frame on the printed papers, and identifying correspondence between the randomly selected at least 20 numbers and individual ones of the 16 numbers in the 4 frame by 4 frame array;

g) the at least first wager being resolved on at least one basis consisting of:

1) a number in the major corner frame corresponds to one of the randomly selected at least 20 numbers selected is a winning outcome on the first wager and the first wager is resolved at first odds, and failure of a number in the major corner frame to correspond to one of the at least 20 numbers selected ends the first wager which is withdrawn from the player position;

2) only upon occurrence of the winning outcome in step 1), correspondence of any first tier of adjacent frames to the major corner frame to any of the randomly selected at least twenty numbers requires positive resolution on a second wager with second odds higher than the first odds in the resolution of the first wager;

3) only upon occurrence of the winning outcome in step 2), correspondence of any further second tier adjacent frames to the first tier of adjacent frames having numbers therein corresponding to the randomly selected at least 20 numbers and which are adjacent to the major corner frame to any of the at least twenty numbers requires positive resolution of a third wager at third odds, with the third odds higher than the second odds in the resolution of the second wager; and 4) only upon occurrence of the winning outcome in step 3), correspondence of any further third tier adjacent frames to the second tier of adjacent frames having numbers therein corresponding to the randomly selected at least 20 numbers and which are adjacent to the second tier of frames requires positive resolution of a fourth wager at fourth odds, with the fourth odds higher than the third odds in the resolution of the third wager.

It is preferred that in addition to the first wager, at least one of the second wager, third wager and fourth wager is made on the 4 frame×4 frame betting array on printed papers. The method is further preferred wherein the printed papers also have printed thereon at least one of i) human readable indications of numbers and types of wagers made on g) and ii) machine readable indications of numbers and types of wagers made on g). It is further preferred that a player inputs to a processor at least a number for printing in the major corner, and the processor then directs a printer to print the exactly 4 frame×4 frame betting array on printed papers, the array having a major corner frame having printed therein the at least a number input by the player to the processor. The method may then operate with a player inputting to a processor at least a number for printing in the major corner, and the processor then directing a printer to print the exactly 4 frame×4 frame betting array on printed papers, the array having a major corner frame having printed therein the at least a number input by the player to the processor.

The 4 frame by 4 frame array is nominally identified by a nomenclature for the frames identified by the intersection of columns A, B, C and D, with rows 1, 2, 3 and 4 and the major corner frame is selected as only one of frames A-1, A-4, D-1 and D-4. See FIG. 2 for this image.

The method may have the first tier of adjacent frames corresponds to frames as:

A-1 first tier frames are A-2, B-1 and B-2;

A-4 first tier frames are A-3, B-4 and B-3;

D-1 first tier frames are C-1, C-2 and D-2; and

D-4 first tier frames are C-4, C-3 and D-3.

The method may have the second tier of adjacent frames corresponds to frames as:

A-1 second tier frames are A-3, B-3, C-3, C-2 and C-1;

A-4 second tier frames are A-2, B-2, C-2, C-3 and C-4;

D-1 second tier frames are B-1, B-2, B-3, C-3 and D-3; and D-4 second tier frames are B-4, B-3, B-2, C-2 and D-2.

The method may have the third tier of adjacent frames corresponds to frames as:

A-1 third tier frames are A-4, B-4, C-4, D-4, D-3, D-2 and D-1;

A-4 third tier frames are A-1, B-1, C-1, D-1, D-2, D-3 and D-4;

D-1 third tier frames are D-4, B-4, C-4, A-4, A-3, A-2 and A-1; and D-4 third tier frames are D-1, C-1, B-1, A-1, A-2, A-3 and A-4, The method may have the third and fourth wagers are positively resolved for only linear alignments of frames from the major corner, through the first tier, the second tier and the third tier of frames as horizontal, vertical or diagonal lines. For example, looking at FIG. 2, with D-4 as the major corner frame, a winning outcome on any of the four wagers must include D-4, linear paylines would include, for example, a) D-4 and D-3; D-4 and C-4; D-4 and C-3; and b) D-4 and D-3 and D-2; D-4 and C-4 and B-4; D-4 and C-3 and B-2; and c) D-4 and D-3 and D-2 and D-1; D-4 and C-4 and B-4 and A-4; D-4 and C-3 and B-2 and A-1.

The nominal third and fourth wagers preferably are positively resolved for only linear alignments of frames from the major corner, through the first tier, the second tier and the third tier of frames as horizontal, vertical or diagonal lines. Thus, although D-4 and D-3 and D-2 and D-1 is a complete 4-number payline, D-4 and D-3 and D-2 and C-1, even though all four numbers are contiguous, only D-4 and D-3 and D-2 are strictly linear. Non-linear paylines may be wagered on, but these linear paylines are preferred as at least one type of available payline.

The method may have the at least 70 numbers consists of 75-80 numbers and the at least 20 names consists of 20-28 or 22-28 numbers. Preferably the method may have the at least 70 numbers as 75-80 numbers (preferably 80 numbers) and the at least 20 numbers as 25 numbers.

The method may be performed on an electronic gaming machine comprising a housing, a computer, a visual display and player input controls, wherein the visual display comprises a touchscreen as at least part of the player input controls, and the 16 numbers are entered into each frame of the 4 frame by 4 frame array by player touchscreen activation of the 16 numbers as a step in entering numbers into each frame.

The method may be practiced where a player contacts a touchscreen and at least one displayed number from the set of at least 70 numbers and slides the number by moving contact into the major corner frame. The method may be practiced wherein the player contacts at least one displayed number from the set of at least 70 numbers and then contacts the major corner frame to insert the contacted at least one displayed number into the major corner frame.

The method may be performed on an electronic gaming machine comprising a housing, a computer, a visual display and player input controls, wherein the visual display comprises a touchscreen as at least part of the player input controls, and the 16 numbers are entered into each frame of the 4 frame by 4 frame array by player touchscreen activation of the 16 numbers as a step in entering numbers into each frame. The player may contact at least one displayed number from the set of at least 70 numbers and slides the number by moving contact into the major corner frame. Alternatively the player contacts at least one displayed number from the set of at least 70 numbers and then contacts the major corner frame to insert the contacted at least one displayed number into the major corner frame. The method may be performed on an electronic gaming machine comprising a housing, a computer, a visual display and player input controls, wherein the visual display comprises a touchscreen as at least part of the player input controls, and the 16 numbers are entered into each frame of the 4 frame by 4 frame array by player touchscreen activation of the 16 numbers as a step in entering numbers into each frame. The method may be performed wherein the player contacts at least one displayed number from the set of at least 70 numbers and slides the number by moving contact into the major corner frame. The method may also be practiced wherein the player contacts at least one displayed number from the set of at least 70 numbers and then contacts the major corner frame to insert the contacted at least one displayed number into the major corner frame.

The technology may also be played in a more physical format, with random selection of frames being done by mechanical elements and wagers resolved by physical or electronic payment. For example, the frame selection may be done by physical apparatus that selects random individual balls, each with unique numbers (e.g., a set of at least 50, at least 60 or at least 70 balls with at least 50, 60 or 70 respectively different numbers), a spinning wheel with at least 70 numbers on it may be spun repeatedly, multiple spinning wheels may be used, and any other physical means that can provide a combination or series of random selection of frame numbers. Recordation of eagers may be done on a printed physical ticket or by electronic receipt and recognition of wagers at individual player positions or on an individual player.

If the major corner number is hit, the system may automatically award all three other corners in the 4×4 array. Although one aspect of the present technology includes the wager requiring a correspondence with a selected number in the major corner, other wagers may be placed in the game, such as any line (including a major corner wager or not), horizontal, vertical or diagonal in the 4×4 matrix. Wagers may also be placed on any three number line, any specific numbers, etc. Turning next to FIG. 1, a video gaming machine 2 that may be used as the underlying base gaming counsel of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaining device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution, in some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaining controller) housed within the main cabinet 4 of the machine 2.

Understand that gaming machine 2 is but one example from a wide range of gaming machine designs on which the present invention may be implemented. For example, not all suitable gaining machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaining machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaining machines Operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaining machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaining machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaining machines have been relatively simple in the sense that the number of peripheral devices and the number of functions the gaining machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically' addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically n found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaining machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
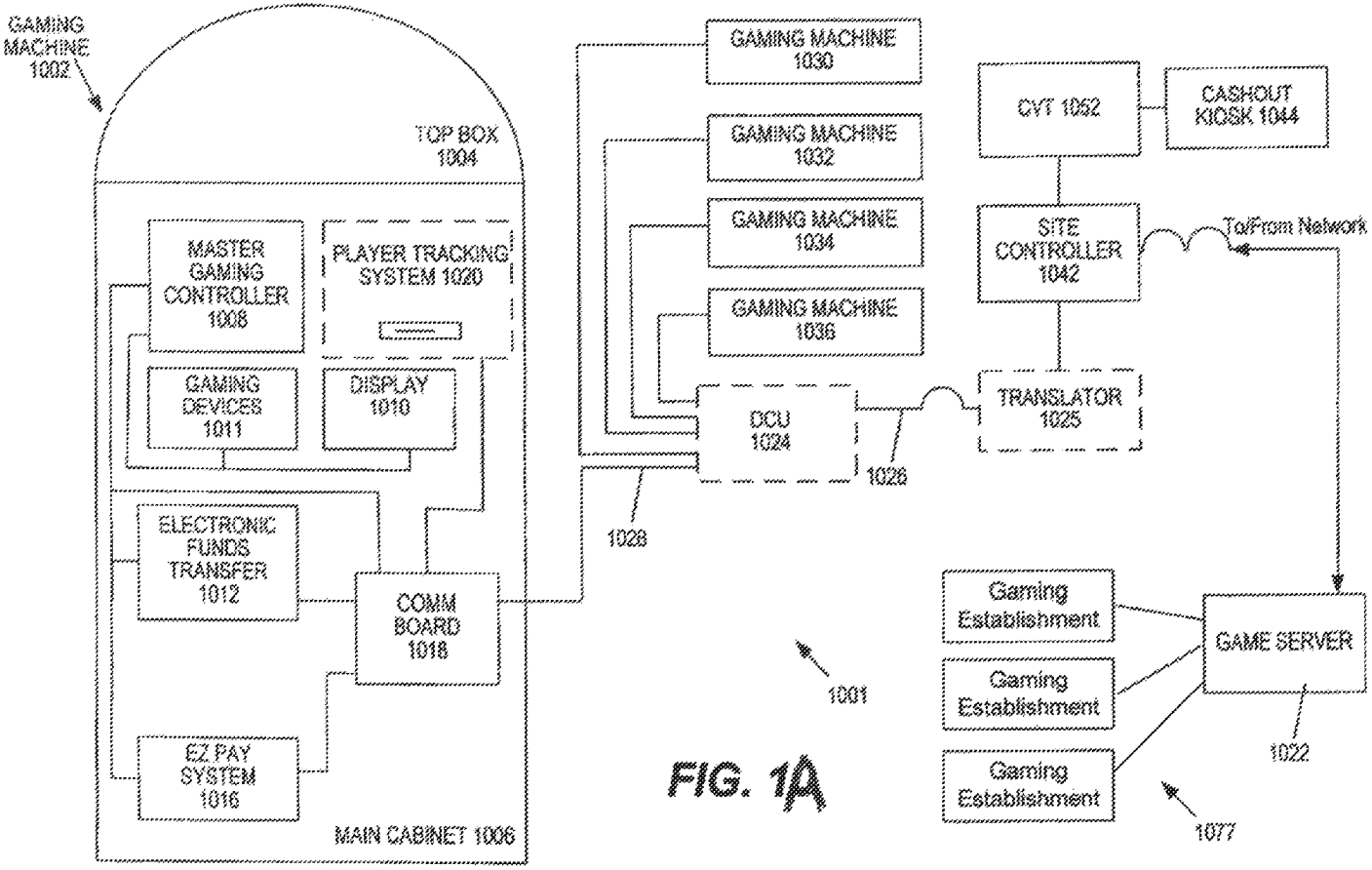
FIG. 1A shows a schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022. Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
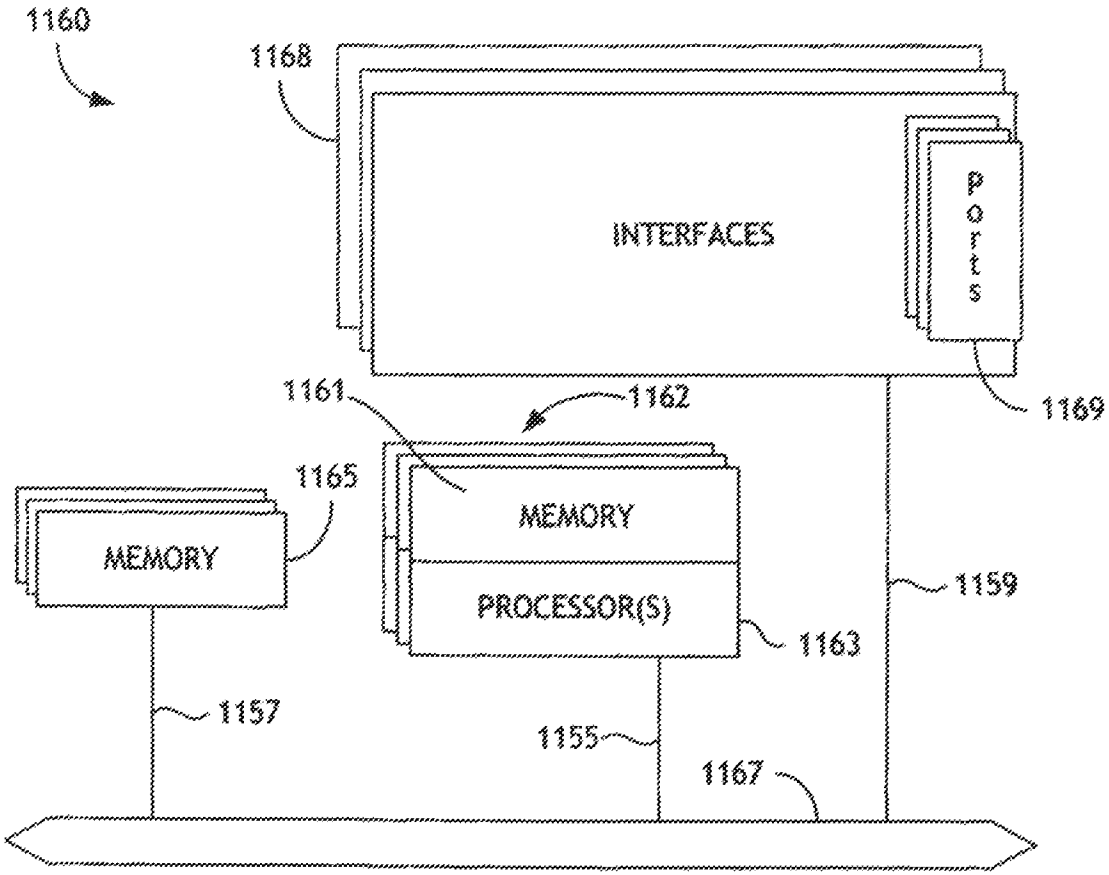
FIG. 1B shows another schematic for an electronic system for enabling play of the gaming method described herein.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

The CPU system may perform additional functions unique to the operation of the present gaming system. The CPU may be engaged with flow meters to measure rates or flow of liquid, volume of total water in the system (by measuring volume in the reservoir when a lowest amount of fluid is in the container and pipes, determination of proportionate payouts dependent upon fluid levels and execution of unique game code. A densitometer in the fluid flow path may be present to determine deterioration in color density or discoloration of the fluid due to contamination, and an alarm is sounded when the color quality (density, tone, wavelengths of absorption and the like) varies beyond predetermined parameters.

Other alternative aspects which may be used by those skilled in the art may be used and remain within the scope of the present technology.

What is claimed:

1. A method of operating a wagering event comprising steps of:

a) receiving at least a first wager from a player;

b) providing a set of at least 50 numbers;

c) providing exactly a 4 frame×4 frame betting array on printed papers, the array having a major corner frame;

d) providing 16 numbers from within the set of 50 numbers, one of the 16 numbers being printed in each frame of the 4 frame by 4 frame array, with at least one printed number from the 16 numbers being in a corner of the 4 frame by 4 frame array, and that corner is thereafter designated as the major corner;

e) randomly selecting and displaying at least 20 numbers from the set of at least 50 numbers;

f) marking the printed papers to at least highlight each one of the randomly selected at least 20 numbers that is also printed in a frame on the printed papers, and identifying correspondence between the randomly selected at least 20 numbers and individual ones of the 16 numbers in the 4 frame by 4 frame array;

g) the at least first wager being resolved on at least one basis consisting of:

1) a number in the major corner frame corresponds to one of the randomly selected at least 20 numbers selected is a winning outcome on the first wager and the first wager is resolved at first odds, and failure of a number in the major corner frame to correspond to one of the at least 20 numbers selected ends the first wager which is withdrawn from the player position;

2) only upon occurrence of the winning outcome in step 1), correspondence of any first tier of adjacent frames to the major corner frame to any of the randomly selected at least twenty numbers requires positive resolution on a second wager with second odds higher than the first odds in the resolution of the first wager;

3) only upon occurrence of the winning outcome in step 2), correspondence of any further second tier adjacent frames to the first tier of adjacent frames having numbers therein corresponding to the randomly selected at least 20 numbers and which are adjacent to the major corner frame to any of the at least twenty numbers requires positive resolution of a third wager at third odds, with the third odds higher than the second odds in the resolution of the second wager; and 4) only upon occurrence of the winning outcome in step 3), correspondence of any further third tier adjacent frames to the second tier of adjacent frames having numbers therein corresponding to the randomly selected at least 20 numbers and which are adjacent to the second tier of frames requires positive resolution of a fourth wager at fourth odds, with the fourth odds higher than the third odds in the resolution of the third wager.

2. The method of claim 1 wherein the 4 frame by 4 frame array is nominally identified by a nomenclature for the frames identified by the intersection of columns A, B, C and D, with rows 1, 2, 3 and 4 and the major corner frame is selected as only one of frames A-1, A-4, D-1 and D-4 and a single number selected from the at least 50 numbers is printed in the major corner.

3. The method of claim 2 wherein in addition to the first wager, at least one additional wager selected from the group consisting of a second wager on filling at one of a first tier of frames, a third wager on filling at least one of a second tier of frames, and a fourth wager on filling at least one of a third tier of frames on the 4 frame×4 frame betting array on printed papers.

4. The method of claim 3 wherein the first tier of adjacent frames corresponds to frames as:

A-1 first tier frames are A-2, B-1 and B-2;

A-4 first tier frames are A-3, B-4 and B-3;

D-1 first tier frames are C-1, C-2 and D-2; and

D-4 first tier frames are C-4, C-3 and D-3.

5. The method of claim 4 wherein in addition to the first wager, at least one of the second wager, third wager and fourth wager is made on the 4 frame×4 frame betting array on printed papers.

6. The method of claim 5 wherein the printed papers also have printed thereon at least one of i) human readable indications of numbers and types of wagers made on g) and ii) machine readable indications of numbers and types of wagers made on g).

7. The method of claim 6 wherein a player inputs to a processor at least a number for printing in the major corner, and the processor then directs a printer to print the exactly 4 frame×4 frame betting array on printed papers, the array having a major corner frame having printed therein the at least a number input by the player to the processor.

8. The method of claim 5 wherein a player inputs to a processor at least a number for printing in the major corner, and the processor then directs a printer to print the exactly 4 frame×4 frame betting array on printed papers, the array having a major corner frame having printed therein the at least a number input by the player to the processor.

9. The method of claim 6 wherein a player inputs to a processor at least a number for printing in the major corner, and the processor then directs a printer to print the exactly 4 frame×4 frame betting array on printed papers, the array having a major corner frame having printed therein the at least a number input by the player to the processor.

10. The method of claim 3 wherein the second tier of adjacent frames corresponds to frames as:

A-1 second tier frames are A-3, B-3, C-3, C-2 and C-1;

A-4 second tier frames are A-2, B-2, C-2, C-3 and C-4;

D-1 second tier frames are B-1, B-2, B-3, C-3 and D-3; and

D-4 second tier frames are B-4, B-3, B-2, C-2 and D-2.

11. The method of claim 3 wherein the third tier of adjacent frames corresponds to frames as:

A-1 third tier frames are A-4, B-4, C-4, D-4, D-3, D-2 and D-1;

A-4 third tier frames are A-1, B-1, C-1, D-1, D-2, D-3 and D-4;

D-1 third tier frames are D-4, B-4, C-4, A-4, A-3, A-2 and A-1; and

D-4 third tier frames are D-1, C-1, B-1, A-1, A-2, A-3 and A-4.

12. The method of claim 3 wherein the first tier of adjacent frames corresponds to frames as:

A-1 first tier frames are A-2, B-1 and B-2;

A-4 first tier frames are A-3, B-4 and B-3;

D-1 first tier frames are C-1, C-2 and D-2; and

D-4 first tier frames are C-4, C-3 and D-3; the second tier of adjacent frames corresponds to frames as:

A-1 second tier frames are A-3, B-3, C-3, C-2 and C-1;

A-4 second tier frames are A-2, B-2, C-2, C-3 and C-4;

D-1 second tier frames are B-1, B-2, B-3, C-3 and D-3; and

D-4 second tier frames are B-4, B-3, B-2, C-2 and D-2; and the third tier of adjacent frames corresponds to frames as:

A-1 third tier frames are A-4, B-4, C-4, D-4, D-3, D-2 and D-1;

A-4 third tier frames are A-1, B-1, C-1, D-1, D-2, D-3 and D-4;

D-1 third tier frames are D-4, B-4, C-4, A-4, A-3, A-2 and A-1; and

D-4 third tier frames are D-1, C-1, B-1, A-1, A-2, A-3 and A-4.

13. The method of claim 12 wherein third and fourth wagers are positively resolved for only linear alignments of frames from the major corner, through the first tier, the second tier and the third tier of frames as horizontal, vertical or diagonal lines.

14. The method of claim 12 wherein the at least 50 numbers consists of 80 numbers and the at least 20 numbers consists of 25 numbers.

15. The method of claim 14 wherein player contacts at least one displayed number from the set of at least 70 numbers and slides the number by moving contact into the major corner frame.

16. The method of claim 12 performed on an electronic gaming machine comprising a housing, a computer, a visual display, player input controls, and a printer, wherein the visual display comprises a touchscreen as at least part of the player input controls, and the 16 numbers are entered into each frame of the 4 frame by 4 frame array by player touchscreen activation of the 16 numbers as a step in entering numbers into each frame, and the electronic gaming machine prints out tickets with the 16 numbers entered by player touchscreen activation printed and filling each frame of the 4 frame by 4 frame array.

17. The method of claim 16 wherein player contacts at least one displayed number from the set of at least 70 numbers and slides the number by moving contact into the major corner frame.

18. The method of claim 3 wherein third and fourth wagers are positively resolved for only linear alignments of frames from the major corner, through the first tier, the second tier and the third tier of frames as horizontal, vertical or diagonal lines.

19. The method of claim 3 wherein the at least 50 numbers consists of 75-80 numbers and the at least 20 numbers consists of 20-28 numbers.

20. The method of claim 3 wherein the at least 50 numbers consists of 75-80 numbers and the at least 20 numbers consists of 22-28 numbers.

21. The method of claim 3 wherein the at least 50 numbers consists of 80 numbers and the at least 20 numbers consists of 25 numbers.

22. The method of claim 3 performed on an electronic gaining machine comprising a housing, a computer, a visual display, player input controls, and a printer, wherein the visual display comprises a touchscreen as at least part of the player input controls, and the 16 numbers are entered into each frame of the 4 frame by 4 frame array by player touchscreen activation of the 16 numbers as a step in entering numbers into each frame, and the electronic gaming machine prints out tickets with the 16 numbers entered by player touchscreen activation printed and filling each frame of the 4 frame by 4 frame array.

23. The method of claim 2 wherein the at least 50 numbers consists of 75-80 numbers and the at least 20 numbers consists of 20-28 numbers.

24. The method of claim 1 performed on an electronic gaining machine comprising a housing, a computer, a visual display, player input controls, and a printer, wherein the visual display comprises a touchscreen as at least part of the player input controls, and the 16 numbers are entered into each frame of the 4 frame by 4 frame array by player touchscreen activation of the 16 numbers as a step in entering numbers into each frame, and the electronic gaining machine prints out tickets with the 16 numbers entered by player touchscreen activation printed and filling each frame of the 4 frame by 4 frame array.

25. A method of operating a wagering event comprising steps of:

a) receiving at least a first wager from a player;

b) providing a set of at least 50 numbers;

c) providing exactly a 4 frame×4 frame betting array on printed papers, the array having a major corner frame;

d) providing 16 numbers from within the set of 50 numbers, one of the 16 numbers being printed in each frame of the 4 frame by 4 frame array, with at least one printed number from the 16 numbers being in a corner of the 4 frame by 4 frame array, and that corner is thereafter designated as the major corner;

e) randomly selecting and displaying at least 20 numbers from the set of at least 50 numbers;

f) marking the printed papers to at least highlight each one of the randomly selected at least 20 numbers that is also printed in a frame on the printed papers, and identifying correspondence between the randomly selected at least 20 numbers and individual ones of the 16 numbers in the 4 frame by 4 frame array;

g) the at least first wager being resolved on at least one basis consisting of:

1) a number in the major corner frame corresponds to one of the randomly selected at least 20 numbers selected is a winning outcome on the first wager and the first wager is resolved at first odds, and failure of a number in the major corner frame to correspond to one of the at least 20 numbers selected ends the first wager which is withdrawn from the player position;

2) only upon occurrence of the winning outcome in step 1), correspondence of any first tier of adjacent frames to the major corner frame to any of the randomly selected at least twenty numbers requires positive resolution on a second wager with second odds higher than the first odds in the resolution of the first wager;

3) only upon occurrence of the winning outcome in step 2), correspondence of any further second tier adjacent frames to the first tier of adjacent frames having numbers therein corresponding to the randomly selected at least 20 numbers and which are adjacent to the major corner frame to any of the at least twenty numbers requires positive resolution of a third wager at third odds, with the third odds higher than the second odds in the resolution of the second wager; and 4) only upon occurrence of the winning outcome in step 3), correspondence of any further third tier adjacent frames to the second tier of adjacent frames having numbers therein corresponding to the randomly selected at least 20 numbers and which are adjacent to the second tier of frames requires positive resolution of a fourth wager at fourth odds, with the fourth odds higher than the third odds in the resolution of the third wager.

26. A method of operating a wagering event comprising steps of:

a) receiving at least a first wager from a player position and optionally at least a second wager, a third wager and/or a fourth wager;

b) providing a set of at least 050 numbers;

c) providing exactly a 4 frame×4 frame betting array at the player position, the array having a major corner frame;

d) providing 16 numbers from within the set of 50 numbers, one of the 16 numbers being in each frame of the 4 frame by 4 frame array, with at least one number in a corner of the 4 frame by 4 frame array designated as a major corner;

e) randomly selecting at least 20 numbers from the set of at least 50 numbers;

f) identifying correspondence between the at least 20 numbers and individual ones of the 16 numbers in the 4 frame by 4 frame array;

g) the first wager being resolved on at least one basis consisting of:

1) a number in the major corner frame corresponds to one of the at least 20 numbers selected is a winning outcome on the first wager and the first wager is resolved at first odds, and failure of a number in the major corner frame to correspond to one of the at least 20 numbers selected ends the first wager which is withdrawn from the player position;

2) only upon occurrence of the winning outcome in step 1), correspondence of any first tier of adjacent frames to the major corner frame to any of the at least twenty numbers requires positive resolution on the second wager with second odds higher than the first odds in the resolution of the first wager;

3) only upon occurrence of the winning outcome in step 2), correspondence of any further second tier adjacent frames to the first tier of adjacent frames having numbers therein corresponding to the at least 20 numbers and which are adjacent to the major corner frame to any of the at least twenty numbers requires positive resolution of the third wager at third odds, with the third odds higher than the second odds in the resolution of the second wager; and 4) only upon occurrence of the winning outcome in step 3), correspondence of any further third tier adjacent frames to the second tier of adjacent frames having numbers therein corresponding to the at least 20 numbers and which are adjacent to the second tier of frames requires positive resolution of the fourth wager at fourth odds, with the fourth odds higher than the third odds in the resolution of the third wager.

* * * * *